United States Patent [19]

Wilson

[11] Patent Number: 5,027,900

[45] Date of Patent: Jul. 2, 1991

[54] INCREMENTAL DENSITY CEMENTING SPACERS

[75] Inventor: William N. Wilson, Plano, Tex.

[73] Assignee: Atlantic Richfield Company, Los Angeles, Calif.

[21] Appl. No.: 484,260

[22] Filed: Feb. 26, 1990

[51] Int. Cl.[5] ..... E21B 33/00

[52] U.S. Cl. ..... 166/285; 166/50; 166/153; 166/292

[58] Field of Search ..... 166/292, 285, 291, 50

[56] References Cited

U.S. PATENT DOCUMENTS

| | | | |
|---|---|---|---|
| 2,582,909 | 1/1952 | Laurence | 166/291 |
| 2,590,814 | 3/1952 | Cardwell et al. | 166/291 |
| 3,850,248 | 11/1974 | Carney | 166/291 |
| 4,083,407 | 4/1978 | Griffin et al. | 166/291 |
| 4,124,075 | 11/1978 | Messenger | 166/291 |
| 4,141,843 | 2/1979 | Watson | 166/291 |
| 4,217,229 | 8/1980 | Watson | 166/291 |

*Primary Examiner*—Ramon S. Britts
*Assistant Examiner*—Roger J. Schoeppel
*Attorney, Agent, or Firm*—James C. Fails; Arthur F. Zobal; Geoffrey A. Mantooth

[57] ABSTRACT

A method of cementing in a wellbore penetrating subterranean formations characterized by employing a graded density spacer fluid intermediate a displacing fluid and a displaced fluid. This is particularly advantageous where a cement slurry is employed as displacing fluid to displace drilling fluid employed to drill a well penetrating subterranean formations. This alleviates problem with intermixing of the two fluids. This invention is doubly advantageous where a well contains both a substantially vertical portion and a substantially horizontal portion, since in the latter portion, the use of this invention enables controlling under-running or over-running of a displacing fluid with respect to a displaced fluid.

2 Claims, 1 Drawing Sheet

INCREMENTAL DENSITY CEMENTING SPACERS

FIELD OF INVENTION

This invention relates generally to well cementing composition and methods. Particularly,. this invention relates to cementing in a wellbore penetrating subterranean formations wherein intermixing due to gravitational force of a displaced fluid, such as drilling fluid, and a displacing fluid such as cement slurry, is minimized.

DESCRIPTION OF THE PRIOR ART

Cement compositions and methods of cementing in wells penetrating subterranean formations are well known and are well documented. Illustrative of prior publications are the following: "Cementing Technology", Dowell Schlumberger, Noble Communications, Ltd., London, England, copyright 1984; and Halliburton Services Catalog entitled "Sales and Service Catalog 43", Halliburton Services, 1911 Walker Street, Suite 967, San Jacinto Building, Houston, Tex. 77002. Both volumes are well indexed and note the use of mechanical separating devices called cementing plugs to separate a displacing cement when displacing a drilling fluid or the like inside a casing. The bottom cementing plug leads the cement slurry and is designed to be caught and then rupture when it reaches the bottom of the casing and thereby allow passage of the displacing fluid, or cement slurry, into the annulus. In the annulus the lighter displaced fluid is located over the heavier displacing fluid in the case of vertical and angled wells. Horizontal and near horizontal wellbores are a special case that will be discussed at a later point herein. The top cementing plug follows the cement slurry to isolate it from the non-setting fluid, usually drilling mud, displacing it from the inside of the casing.

Cement slurry and drilling fluid are typically incompatible in that they react chemically forming a highly viscous and highly gelled mixture resulting in rheology unsuitable for achieving an efficient displacement of the drilling fluid by cement slurry. An intermediate fluid called a cementing spacer is usually designed and employed to minimize that effect. Cementing spacer fluid is typically prepared at a single uniform density which will be between the density of a displaced fluid like drilling fluid and the density of the cement slurry. Spacer fluid should be compatible with drilling fluids and cement slurries. A recent model study conducted by the assignee of this invention showed that the gravitational exchange rate between fluids of different densities inside casing might reach as much as 4500 feet per hour when conventional separating devices such as bottom cement plugs are not employed. This can lead in a real situation to a significant volume of contaminated mixture whose viscosity is typically too high to measure with the standard rheological instruments such as a Fann Viscometer. Formation of this mass of thick fluid will almost certainly damage the quality of the cement job; particularly, where it becomes lodged in the lower part of the annulus where a good cementing seal is very important. Gravitational invasion of a heavier fluid into a lighter fluid under conditions typical of most cementing applications will occur more often than not and faster and to a greater degree due to slipping of the heavier fluid into the lighter fluid such as cement slurry into spacer or spacer into drilling fluid, aggravating the degree of contamination if a mechanical separating device is not or cannot be used such as when cementing liners and in some offshore cementing applications. Placement of a dense fluid such as cement slurry on top of lighter fluid such as water may result in a reduced rate and degree of invasion because of the turbulent gravitational interaction of the two fluids; that is, eddies flow upward as much as they flow downward. Gravitational interaction is aggravated by the fluids being in laminar flow which is often the case during cementing.

Prior art has failed to provide a method of preventing intermixing, or to minimize intermixing inside casing between a displaced drilling fluid and displacing slurry of cement when mechanical devices are not or cannot be used when cementing wells downhole or penetrating subterranean formations.

SUMMARY OF THE INVENTION

Accordingly, it is an object of this invention to provide a method of cementing in wells penetrating subterranean formations which minimizes the mixing of the cement slurry in cementing spacer as displacing fluids with the displaced drilling fluid when cementing wells downhole.

It is a further object of this invention to provide a method of alleviating problems with a mixture of cement and drilling fluids with a deleterious effects on both the cement slurry and the drilling fluid because of additives contained in respective fluids.

These and other objects will become apparent from the description hereinafter, particularly when taken in conjunction with the appended drawings.

In accordance with this invention there is provided a method of minimizing gravitational exchange problems inside a casing or liner by incrementally increasing the density of a spacer fluid located between a drilling fluid and a cement slurry from that of the drilling fluid to that of the cement slurry that is being employed to displace the drilling fluid initially. This grading of density will effectively slow the rate of intermingling of the fluids so that these fluids, even when they are not protected by mechanical separating plugs, will be more nearly completely intact when they move into the annulus to accomplish their intended purposes. The theoretical length of an incrementally increasing density cementing spacer can be calculated for different kinds of cement jobs so that the time required for the spacer to reach the annulus is equal the rate of commingling of the fluids during their descent. A copy of a computer simulation of cement slurry over drilling fluid inside casing is enclosed as an example hereinafter. On the other hand, experience through a plurality of cementing jobs will delineate a number of increments of necessity employed between the drilling fluid as well as the volume of the respective plugs of the spacer fluid, cement and any other displacing fluid. Such empirical, or experimental, data will be accumulated over several cementing jobs in the event the initial calculation is not accurately done.

DESCRIPTION OF PREFERRED EMBODIMENT(S)

This invention may be useful in either primary cementing jobs or remedial cementing jobs. It is ordinarily most advantageous where a drilling fluid is being employed in a well and where it is displaced by a cementing spacer and/or cement slurry or the like. Of course, other fluids having different densities from the cement slurry and drilling fluid can make use of the principles of this invention.

The well cementing methods of this invention make use of conventional water, hydraulic cement and spacer fluids, as well as advantageous additives for each.

The water can be of any conventionally employed water for making oil well cement. This is well understood and should not include aqueous solutions of reactants that will adversely affect properties of the cement.

The term "hydraulic cement" encompasses any inorganic cement which hardens or sets under water although for practical purposes this means Portland cement which is commercially available. The cement will be chosen in accord with the properties desired or recognized. Additional additives such as silica flour, retarders or the like can be employed as necessary. Fluid loss additives are sometimes employed to reduce filtrate loss and help control damage to the formation.

In fact, almost any of the additives that can be employed in conventional prior art cementing technology can be employed herein without adversely affecting to an intolerable degree the operation of this invention.

The cement slurry mix is in accordance with known technology to form a pumpable slurry. As is well known, the amount of water employed may vary over considerable range and is set forth in API Spec 10, which is known in the cement industry. As described therein a pumpable slurry is defined in terms of Bearden units of consistency (Bc) and a pumpable slurry is ordinarily in the range of 5-25 Bc and preferably in the range of 7-15 Bc. Slurries thinner than 5 Bc have a tendency to have greater particle settling and free water generation. Slurries thicker than 15 Bc become increasingly difficult to pump with elapsed time.

Depending upon the particular slurry and intended conditions of use, mixing water is used in the slurry in the range from about 30 to about 130 percent by weight based on the weight of the dry cement. Preferably, water is employed in a proportion in the range of 40 to 100 percent by weight.

The displaced fluid in this instance will be a drilling fluid although other density fluids could be employed as desired. In this instance the drilling fluid as the displaced fluid will typically have a density in the range of 8.33-20 pounds per gallon.

The cement slurry as a displacing fluid will have a density in the typical range of 11-20 pounds per gallon.

The spacer fluid will have a weighting agent sufficient to increase the density intermediate the two densities between that of the displaced fluid and the displacing fluid.

Figure 1:
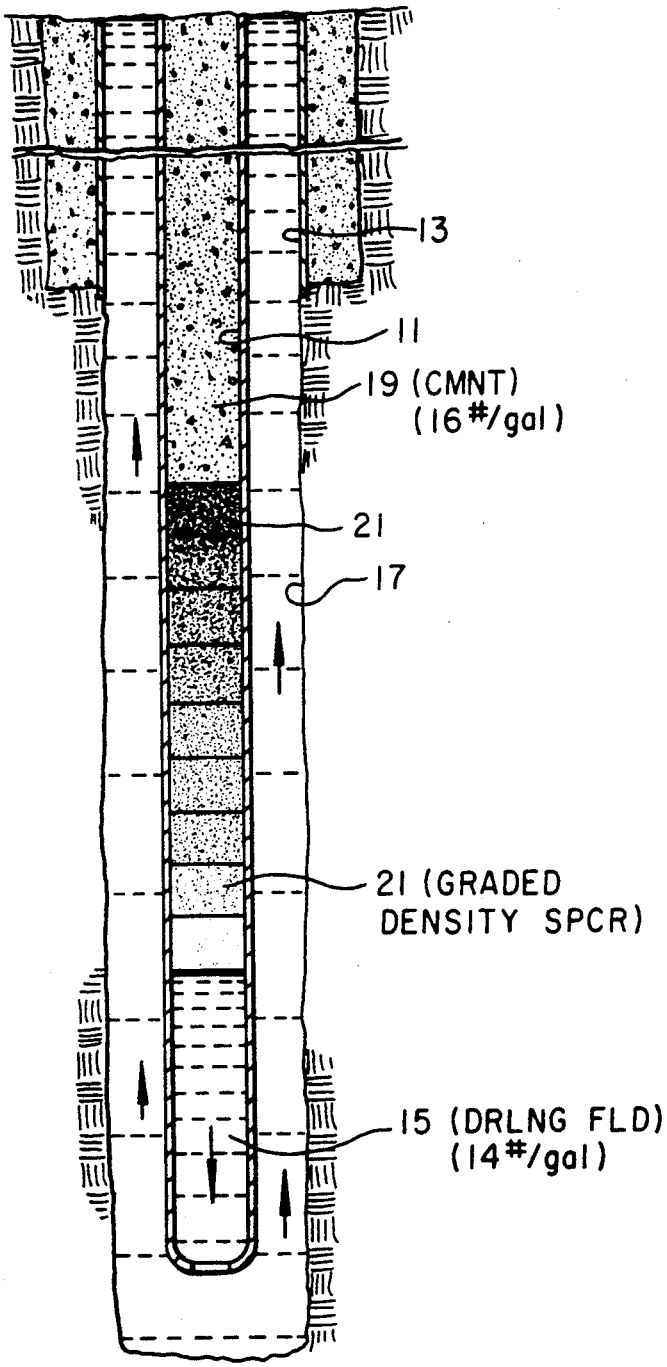
FIG. 1 is a partial schematic view of an embodiment of this invention in which a graded density spacer fluid is employed between displacing cement slurry and a drilling fluid at illustrative densities encountered in the field.

In accordance with this invention, casing is cemented in a well penetrating subterranean formations by the following multi-step method. The first step is to determine the density of the drilling fluid. This is ordinarily known and may be about; for example, 14 pounds per gallon. This is shown in FIG. 1 as "Drlng fld—14#/gal". Next the density of the cement slurry that is going to be employed is determined. This may be about 16 pounds per gallon; for example, in FIG. 1, as "Cmnt—16#/gal". Separating the cement from the displaced fluid will be a graded density spacer shown as "graded density spcr". The initial plug of cement spacer next to the 14 pound drilling fluid, for example, may be about 14 pounds per gallon and there might comprise many graded density plugs, for example about 100 segments if desired until the plug of spacer next to the cement slurry weighs 16 #/gal. In practice it may be monotonically incrementally increased over a substantial number of increments. On the other hand, as few as only several density plugs may be employed as a spacer. It is important to employ a plurality of plugs in order to get the desired graded density and viscosity. Typically the gradation of density and viscosity between plugs may range from about 0.01% to as much as 20% of the total density and viscosity difference. Additional weighting material may be employed. Weight material, such as barium sulfate, is well known. The barium sulfate, or other weighting material will be inert and will not participate in the reaction of the cement during setup but is simply to afford an increasing density of the spacer fluid between the drilling fluid and the cement slurry that is being employed as the displacing fluid in FIGS. 1 and 2. Obviously, the density gradations can go the other way, or be less, if desired. In the illustrated embodiment, a drilling fluid 15 may be employed in a wellbore 17 penetrated by casing 11. Inside the casing 11, cement will be circulated downhole until it begins to be received at a desired point, such as back at the surface. This is an indication that the cement will have displaced the drilling fluid from the annular space about the casing into the borehole 17 of the wellbore penetrating subterranean formations (not shown). In FIG. 1 the slug of cement slurry is given the reference numeral 19.

If desired, of course, a graded viscosity spacer fluid can be employed between the cement slurry and any displacing fluid employed therebehind to minimize commingling between the spacer fluid, displaced fluid and displacing fluid.

Figure 2:
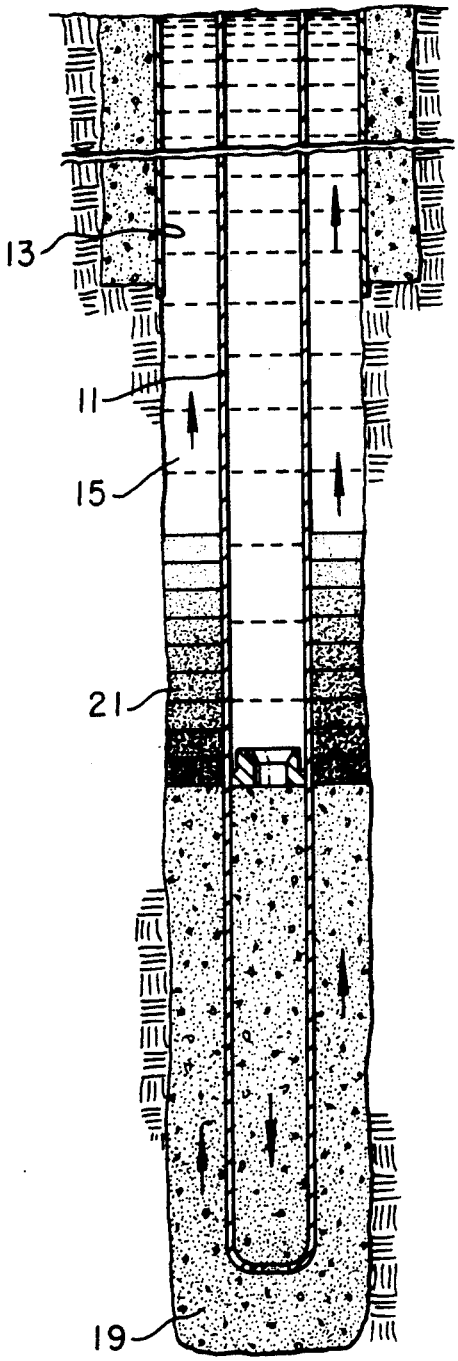
FIG. 2 is a partial cross-sectional view, partly schematic, of the embodiment of FIG. 1.

Referring to FIG. 2, the drilling fluid 15 has been displaced on around into the annular space. Similarly, the cement slurry 19 is being displaced from the casing and occupies the bottom externally of the casing 11. The leading edge of the cement slurry 19 may be dedicated for "scavenger slurry" as "spacer fluid" or employed in addition to a specifically formulated cementing spacer fluid and may also be incrementally graded to enhance its effectiveness as such. The graded density spacer fluid shown by the number 21 in both FIGS. 1 and 2, will typically occupy the space between all cement slurry and the drilling fluid.

The graded density "spacer fluid" prepared as scavenger cement slurry may be employed by simply adding the weighting material such as barium sulfate to the hopper in which the cement slurry is being admixed. For example, initially there will be a 14 pound per gallon density cement slurry employed as a plug of "spacer fluid" and the densities of subsequent plugs will be graded upwardly by increasing the amount of barium sulfate or other weighting agent added until the density desired for the cement slurry; for example, 16 pounds per gallon, is achieved. Obviously, the desired effect can be achieved by mixing the cement slurry dedicated as scavenger or spacer with excess water, and then gradually densifying the slurry to its design water ratio yielding a 16#/gal density. This is the preferred method. Note: The loss of hydrostatic pressure resulting from a higher water ratio is usually not substantial enough to create well control problems.

The mixing units in which the dry ingredients are mixed with water and other additives are well known and need not be described herein. They are commercially available; for example, from Halliburton, or the like.

In the case of cementing horizontal and near horizontal and very high angle wellbores, gravitational commingling of fluids in a casing and/or annulus can occur perpendicular to the axis of the wellbore leading to over-running or under-running of displaced and displacing fluids and spacers across the length of the wellbore being treated. The subject previously described herein invention can be employed to control such commingling due to gravitational forces and the variation in viscosity of an increasing density cement spacer having a higher water ratio near the displaced fluid will also achieve turbulence at a lower flow velocity and tend to clear the annulus of settled solids and dilute out residual displaced fluid or drilling fluid.

Spacer fluids are known. The inventor herein is also a co-inventor of a patent application entitled "Spacer Fluid", filed Nov. 27, 1989 Ser. No. 07/441,853 and assigned to the assignee of this patent application and the descriptive matter of that application is incorporated herein by reference.

EXAMPLES

The following examples illustrate an aspect of employing a method of this invention in specific instances.

EXAMPLE I

Herein, a sixteen pound per gallon density cement slurry was employed to displace a 14 pound per gallon density drilling fluid. The drilling fluid had lignosulfonate retarders in it that was not desired to admix with cement slurry. Moreover, undesirable thickening of the drilling fluids when commingling with the cement slurry was to be avoided. Accordingly, a hydraulic cement slurry having a density of about 16 pounds per gallon was employed to displace the drilling fluid. An initial plug of a specifically formulated cementing spacer fluid was employed. It had an initial density approaching 14 pounds per gallon about like the drilling fluid that it was to displace. An additional wetting fluid was mixed into the first plug of the spacer fluid so that a spacer slurry having a density of about 14.2 pounds per gallon was employed. Thereafter, the spacer fluid had enough additional weighting material, barium sulfate, added to increase the density about 0.2 pounds per gallon for each plug, or slug, so that about 10 slugs enabled achieving the target density of the cement slurry in the tenth slug, or about 16 pounds per gallon.

EXAMPLE II

PRUDHOE BAY UNIT DRILL SITE 5-21 was drilled as a horizontal well to 11,300' measured depth. The 8178 " section of the hole was drilled with oil base drilling mud. After drilling to TD, a polymer pill was set in the open hole below the liner setting depth at 10,200' to prevent cement slurry from falling into the open hole. The liner was reciprocated while circulating to condition the hole prior to cementing and while pumping spacer and finally while pumping the cement slurry. A three stage spacer system was pumped ahead of the cement slurry. Fifty bbls of diesel at approximately 6.8 ppg containing 1% S-400 surfactant to water wet the casing, followed by 50 sacks of scavenger slurry that was gradually weighted up from 8.33 ppg to 15.8 ppg made up the three stage cementing spacer system. The liner was cemented with B J. Titan's Gas bond cement mixed at 15.8 ppg. The cement bond log showed excellent pipe to cement bond with no drilling fluid channels.

In the foregoing examples, the cement job was good and laboratory tests indicated that no undisplaced drilling fluid was employed and no appreciable intermixing between the drilling fluid and the cement slurry was effected. The computer simulation of Example III showed advantageous shortening of the interface in a near horizontal section of the well.

From the foregoing, it can be seen that this invention achieves the objects delineated hereinbefore and enables employing a graded density spacer fluid intermediate a displaced fluid and a displacing fluid to obviate, or alleviate problems with intermixing of the two fluids.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. In a method of cementing a well having a substantially vertical portion in which the method achieves its advantages and a substantially horizontal portion in which the method is advantageous in enabling controlling under-running and over-running of a displaced fluid and comingling with a displacing fluid at an interface therebetween;

the improvement comprising:

employing intermediate a displacing fluid of a first density and a displaced fluid of a second density, a spacer fluid of density increments intermediate the first and second density in order to alleviate problems of intermixing of the displacing fluid and the displaced fluid.

2. In a method of cementing a well penetrating subterranean formations, in which a displaced fluid is displaced by a displacing fluid; the improvement comprising:

employing intermediate a displacing fluid of a first density and a displaced fluid of second density, a spacer fluid of density increments intermediate the first and second density in order to alleviate problems of intermixing of the displacing fluid and the displaced fluid; said spacer fluid being a cement spacer system of various amounts of water diluting the cement system for density control.

* * * * *